United States Patent [19]

Johnson, Jr.

[11] Patent Number: 4,762,499

[45] Date of Patent: Aug. 9, 1988

[54] SURFACE MOUNT CONNECTOR AND MATING CONNECTOR THEREFOR

[76] Inventor: Henry G. Johnson, Jr., 5 Abbey Rd., East Hampton, Conn. 06426

[21] Appl. No.: 33,785

[22] Filed: Apr. 3, 1987

[51] Int. Cl.[4] ..... H01R 11/03

[52] U.S. Cl. ..... 439/66

[58] Field of Search ..... 439/66, 74, 819, 821, 439/822

[56] References Cited

U.S. PATENT DOCUMENTS 3,169,816 2/1965 Hammond et al. ..... 439/822

4,408,814 10/1983 Takashi et al. ..... 439/66

*Primary Examiner*—Joseph H. McGlynn

*Attorney, Agent, or Firm*—CTC & Associates

[57] ABSTRACT

A connector mountable on the surface of a printed circuit board (PCB) has a body of insulating ceramic material having a bottom surface, a main top surface facing away from the bottom surface, additional surfaces interconnecting the bottom and main top surfaces and each other including oppositely facing side surfaces, and an electrical lead having a bottom end portion on the bottom surface, a top end portion on the main top surface and additional portions on the additional surfaces and providing circuit continuity on the exterior of the body between the end portions of the lead, the bottom end portion being affixable to a pad on the surface of the PCB. A mating connector includes two body members of insulating plastic material pivotally connected for limited movement about a hinge pin, each body member having an inwardly facing planar surface, and a spring urging the inwardly facing surfaces toward each other. The inwardly facing surfaces of the mating connector are spaced apart a distance so that they can straddle and engage the first and second side surfaces of the surface mountable connector in positive mating engagement therewith. The mating connector has a configuration for receiving and holding an external circuit element in electrical contact with the lead.

17 Claims, 2 Drawing Sheets

SURFACE MOUNT CONNECTOR AND MATING CONNECTOR THEREFOR

BACKGROUND OF THE INVENTION

This invention relates to electrical connectors and more particularly to a surface mount electrical device (SMD) or connector that is mountable on the surface of a printed circuit board (PCB) and to a mating connector for the surface mount connector.

Presently used SMDs have several disadvantages, among which are severe temperature problems and problems associated with the very small centerline-to-centerline pad spacing of PCBs, typically 0.025 inch (0.06 cm) to 0.05 inch (0.13 cm).

Temperature problems are encountered during vapor phasing when it is attempted to flow solder paste from the PCB pads tu the SMD leads. SMDs currently available have bodies made of plastic and have male and female pins. The plastic is intolerant to the high temperatures encountered in the soldering operation and the SMDs are susceptible to damage by soldering irons.

The very small centerline-to-centerline spacing problems of the prior art are occasioned by the fact that with the prior devices it is very difficult to avoid deformation of the male and female pins (mentioned above). If such deformation occurs, the result is at best intermittent operation of the PCB.

It is therefore an important object of the invention to provide an improved SMD and mating connector therefore that have the advantages that they overcome the just-described problems of the prior art.

It is a further object to provide a highly reliable,low profile access to electrical test points or signal lines of PCBs.

It is an additional object to provide a mating connector giving rise to zero insertion force or very low insertion and extraction force.

It is a still further object to provide a mating connector having a positive mating surface between the SMD and the mating connector.

Additional objects and advantages will appear hereinafter.

Applicant is aware of the following prior U.S. patents, none of which seem relevant to the present invention:

| U.S. Pat. No. | Date | Inventor |
|---|---|---|
| 4,254,301 | March 3, 1981 | Serino |
| 4,362,904 | December 7, 1982 | Schneider et al. |
| 4,395,585 | July 26, 1983 | Polcyn |
| 4,417,296 | November 22, 1983 | Schelhorn |
| 4,513,353 | April 23, 1985 | Bakermans et al. |
| 4,574,297 | March 4, 1986 | Ooi |

SUMMARY OF THE INVENTION

The invention presents a connector that is mountable on the surface of a printed circuit board (PCB). The surface mountable connector has a body of insulating ceramic material having a bottom surface, a main top surface facing away from the bottom surface, additional surfaces interconnecting the bottom and main top surfaces including oppositely facing side surfaces, and each other,and an electrical lead having a bottom end portion on the bottom surface, a top end portion on the main top surface and additional portions on the additional surfaces. The lead provides circuit continuity on the exterior of the body between the end portions of the lead. The bottom end portion of the lead is affixable to a pad on the surface of the PCB.

The invention further presents a mating connector that includes two body members of insulating plastic material pivotally connected for limited movement about a hinge pin, each body member having inwardly facing planar surface,and a spring urging the inwardly facing surfaces toward each other. The inwardly facing surfaces of the mating connector are spaced apart a distance so that they can straddle and engage the first and second side surfaces of the surface mountable connector in positive mating engagement therewith. The mating connector has a configuration for receiving and holding an external circuit element in electrical contact with the lead.

DESCRIPTION OF THE INVENTION

Figure 1:
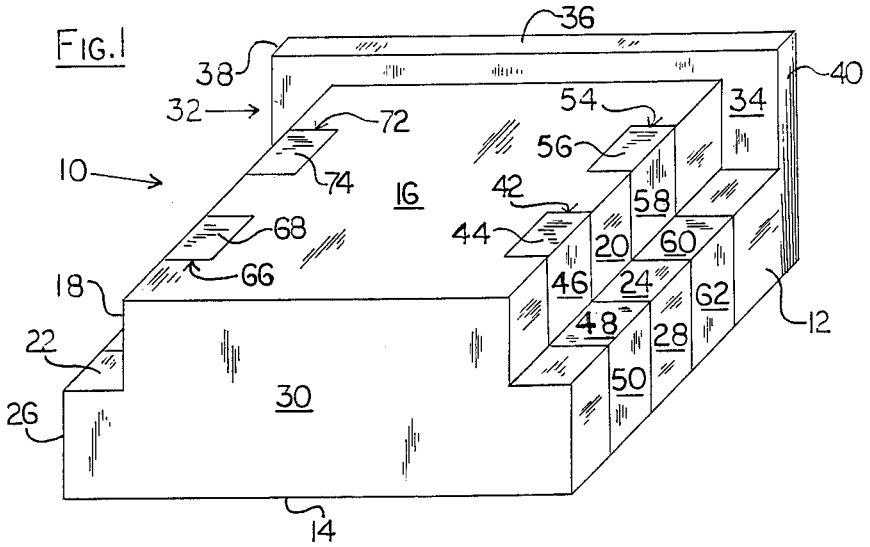
FIG. 1 is a perspective view of a preferred embodiment of a surface mount connector embodying the invention.
Figure 2:
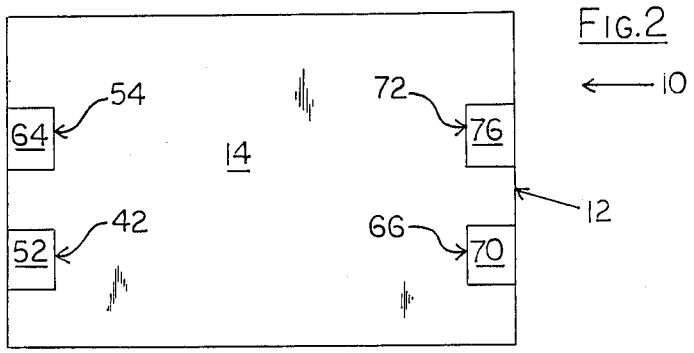
FIG. 2 is a bottom plan view of the surface mount connector of FIG. 1.
Figure 4:
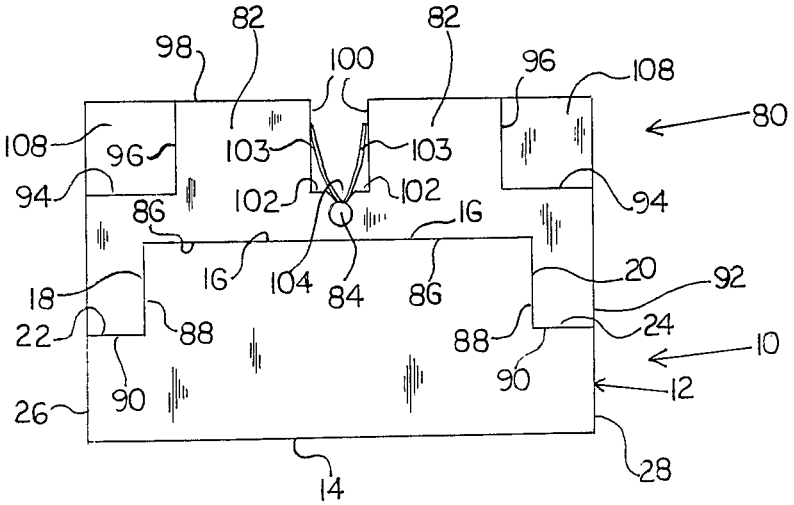
FIG. 4 is an end view of the surface mount connector of FIG. 1 and the mating connector of FIG. 3 in assembled relationship.

FIGS. 1, 2 and 4 show a preferred surface mount connector, or SMD, indicated generally at 10, embodying the invention. Connector 10 comprises a one-piece block 12 of electrically insulating material, a preferred example of which is ceramic for resistance to temperatures in excess of 400 degrees F., which are encountered in soldering. Block 12 has a rectangular bottom surface 14, a rectangular main top surface 16 parallel to bottom surface 14 facing the direction opposite that faced by surface 14 and of substantially the same length as bottom surface 14 but narrower than bottom surface 14.

Rectangular parallel oppositely facing side surfaces 18 and 20 depend perpendicularly from opposite side edges of top surface 16 and coplanar rectangular supplementary top surfaces 22 and 24 project perpendicularly outwardly from the lower longitudinal edges of surfaces 28 and 20, respectively. Rectangular parallel oppositely facing side surfaces 26 and 28 depend perpendicularly from opposite side edges of surfaces 22 and 24, respectively, and intersect the side edges of bottom surface 14. Surfaces 18 and 20 have the same dimensions,as do surfaces 22 and 24, as do surfaces 26 and 28.

Block 12 further has an end surface 30 facing the viewer in FIGS. 1 and 4, perpendicular to bottom surface 14 and providing an end for bottom surface 14, top surface 16, surface 18, surface 20, surface 22, surface 24, surface 26 and surface 28. As shown, and for a purpose described hereinafter, block 12 further has at the end thereof remote from surface 30, an upstanding flange 32 presenting a locating surface 34 parallel to and facing in the same direction as surface 30 and determining the ends of surfaces 16, 18, 20, 22 and 24 remote from surface 30. Flange 32 also has a top surface 36 parallel to surface 16 and side surfaces 38 and 40 that are continuations of surfaces 26 and 28, respectively, and an unnumbered surface parallel to surface 34 and facing in the opposite direction and providing the end of block 12 remote from surface 30. A flange similar to flange 32 could also be provided, if desired, at the end of block 12 facing the viewer in FIG. 1.

Connector 10 further comprises an electrical lead 42 having rectangular portions 44, 46, 48, 50 and 52 on surfaces 16, 20, 24, 28 and 14, respectively, and a like electrical lead 54 spaced from lead 42 and having rectangular portions 56, 58, 60, 62 and 64 on surfaces 16, 20, 24, 28 and 14, respectively. Connector 10 further comprises an electrical lead 66 aligned with and a mirror image of lead 42, having rectangular portions 68 and 70 on surfaces 16 and 14, respectively, in addition to unseen rectangular portions on surfaces 18, 22 and 26,and an electrical lead 72 aligned with and a mirror image of lead 54, having rectangular portions 74 and 76 on surfaces 16 and 14, respectively, in addition to unseen rectangular portions on surfaces 18, 22 and 26.

Leads 42, 54, 66 and 72 can be formed on body 12 by a known method which need not be described, and each provides, on the exterior of body 12, circuit continuity from surface 16 to surface 14, along exterior surfaces 20, 24 and 28,in the case of leads 44 and 54, and along surfaces 18, 22 and 26, in the case of leads 66 and 72.

Leads 42, 54, 66 and 72 have upper portions 44, 56, 68 and 74, respectively, on top surface 16 in order to allow leads 42, 54, 66 and 72 to be probed without damaging the adjacent portions of leads 42, 54, 66 and 72 on surfaces 18, 20, 22 and 24.

In addition, lead portions 52, 64, 70 and 76 can be pre-tinned and soldered to pads on the surface of a PCB (not shown), thus to mount connector or SMD 10 on the surface of the PCB.

Connector or SMD 10 provides a highly reliable, reusable low profile means of access to electrical test points or signal lines on the PCB and can be placed on the PCB at the same time as other SMD components and then sent to vapor phase.

Figure 3:
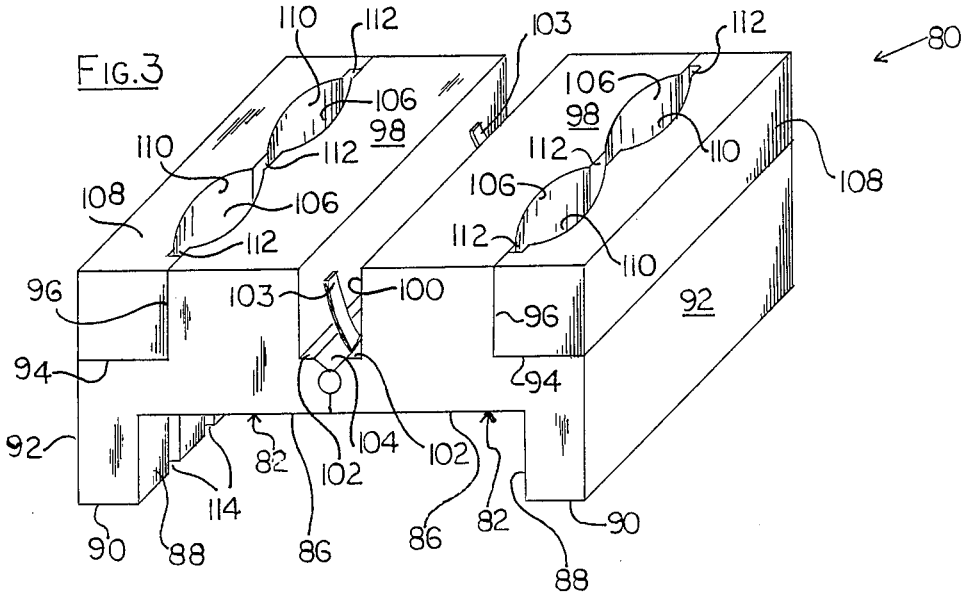
FIG. 3 is a perspective view of a preferred embodiment of a mating connector embodying the invention.

FIGS. 3 and 4 show a mating connector, indicated generally at 80, for releasable mating engagement with connector 10. Mating connector 80 provides means for making electrical connection with the pads of the PCB and comprises two identical body members 82 of electrically insulating material pivotally connected together about on a hinge pin 84 in alligator-clip type fashion. Members 82 are of a suitable plastic material, and each member 82 is configured to include a downwardly facing planar surface 86 terminated by an inwardly facing planar surface 88 perpendicular to surface 86, the lower edge of which is intersected by a bottom surface 90 parallel to surface 86.

Surface 86 is shaped and dimensioned so that the two surfaces 86 together will substantially cover and conform to main rectangular top surface 16 of connector 10, both laterally and longitudinally, with surfaces 88 extending downwardly from the longitudinal edges of surfaces 86, along and confronting side surfaces 18 and 20 of connector 10, and with surfaces 90 confronting supplementary top surfaces 22 and 24 of connector 10, the height of surfaces 88 being substantially the same as the height of side surfaces 18 and 20.

Members 82 also have oppositely facing side surfaces 92 extending upwardly from the edges of surfaces 90 remote from surfaces 88 to a location above the plane of surfaces 86, surfaces 92 being spaced apart a distance substantially the same as the distance between side surfaces 26 and 28 of connector 10.

The upper edges of surfaces 92 are terminated by upwardly facing surfaces 94 parallel to surfaces 90, the inner edges of surfaces 94 are terminated by oppositely facing side surfaces 96 perpendicular to surfaces 94, and the upper edges of surfaces 96 are terminated by top surfaces 98 which are parallel to surfaces 86.

Surfaces 94 and 96 of each member 82 provide that member 82 with a longitudinal step, and the inner edges of surfaces 98 are terminated at their inner edges by surfaces 100 perpendicular to surfaces 98. The lower edges of surfaces 100 are terminated at their lower edges by upwardly facing surfaces 102 having beveled edges providing a longitudinal groove 104 immediately adjacent hinge pin 84. Spring means schematically indicated at 103 surrounds hinge pin 84 and engages surfaces 100, thus resiliently urging surfaces 88 toward each other.

Surfaces 96 are provided with vertical shallow grooves 106, in open communication with surfaces 98 and 86. Two identical lip members 108 are removably mounted, as described below, one on each member 82, on the step provided by surfaces 94 and 96, and coextensive longitudinally thereof. Lip members 108 are provided with vertical shallow grooves 110 confronting grooves 106. Grooves 110 are provided with relieved portions 112 at their sides.

Surfaces 88 are provided with vertical grooves 114 that are aligned with relieved portions 112.

FIG. 4 is an end view showing mating connector 80 mounted on surface mount connector 10.

Figure 5:
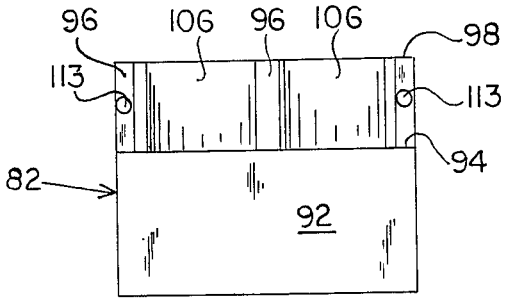
FIG. 5 is a side plan view of a component of the mating connector of FIG. 3.
Figure 6:
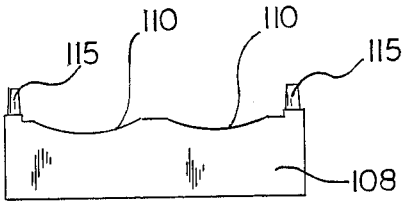
FIG. 6 is a top plan view of another component of the mating connector of FIG. 3.

FIG. 5 is a side plan view of member 82, looking directly at surface 92 thereof, and showing a pair of cylindrical holes 113 in surface 96, near the ends thereof. FIG. 6 is a top plan view of lip member 108, showing projections 115 near the ends thereof. Projections 115 are hollow and are positioned and dimensioned to enter holes 113 and be slightly compressed thereby, thus resiliently and releasably to hold member 108 in assembled relationship with member 82.

Mating connector 80 can be pressed together at the top, to pivot members 82 about hinge pin 84 to increase the distance between surfaces 88, against the bias of the spring, to allow mating connector to be fitted onto block 12 of connector 10, with one end of connector 80 abutting locating surface 34, thus positioning confronting pairs of grooves 106 and 110 and relieved portions 112 in registry with leads 42, 54, 66 and 72. When mating connector 80 is released, the spring will hold connector 80 on connector 10, surfaces 88 providing positive mating surfaces between connectors 10 and 80, and ribbon cable can be inserted into groove pairs 106/110 into electrical engagement with leads 42, 54, 66 and 72 with zero or very low insertion force. Alternatively, pin connectors (not shown) can be passed into relieved portions 112 and grooves 114 into such electrical engagement. Thus, connector 80 is configured to receive and releasably hold external circuit elements, such as ribbon cables or pin connectors, in electrical contact with leads 42, 54, 66 and 72, with zero or very small insertion force.

Groove pairs 106/110 and relieved portions 112 are equispaced from the longitudinal ends of connector 80 so that connector 80 can be applied to connector 10 with either end of connector 80 abutting locating surface 34. The locating function surface 34 could alternatively be provided in other ways, such as by an additional surface (not shown) on connector 80.

Figure 7:
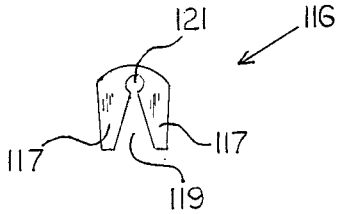
FIG. 7 is a top plan view of a retainer that is useful in the mating connector.

FIG. 7 shows in top plan view a retainer 116 of copper or other conductive metal. Retainer 116 has legs 117 having therebetween a tapered groove 119 with an arcuate bottom 121.

Retainers 115 can be installed in grooves 106, so that the bottom ends of retainers 115 are in electrical contact with leads 42, 54, 66 and 72 when mating connector 80 is assembled with connector 10. Wires (not shown) pushed downwardly into grooves 119 will thus be placed in electrical contact with leads 42, 54, 66 and 72.

The invention well attains the stated objects and advantages and others.

The disclosed details are exemplary only and are not to be taken as limitations on the invention except as those details are included in the appended claims.

What is claimed is:

1. A connector mountable on the surface of a printed circuit board (PCB), said connector comprising a unitary body of rigid electrically insulating material having a bottom surface, a main top surface facing away from said bottom surface, additional surfaces interconnecting said bottom and main top surfaces and each other, and an electrical lead localized on the exterior of said body and having a bottom end portion on said bottom surface, a top end portion on said main top surface and additional portions on said additional surfaces and providing circuit continuity on the exterior of said body between said end portions, said bottom end portion being affixable to a pad on the surface of the PCB.

2. A connector according to claim 1 wherein said insulating material is ceramic.

3. A connector according to claim 1 wherein said additional surfaces include a planar side surface depending from a side edge of said main top surface and making an angle with said main top surface, as measured within the material of said body, of not more than 90 degrees.

4. A connector according to claim 1 wherein said bottom surface is planar and of rectangular shape, said main top surface is planar and parallel to said bottom surface and extends between first and second parallel side edges and said additional surfaces include a first side surface depending from said first side edge and making an angle with said main top surface, as measured within the material of said body, of not more than 90 degrees, said body further including a second side surface depending from said second side edge and making an angle with said top surface, as measured within the material of said body, of not more than 90 degrees.

5. A connector according to claim 4 wherein each of said angles is 90 degrees, whereby said first and second side surfaces are parallel to each other.

6. A connector according to claim 5 wherein said first side surface extends from said first side edge to a third side edge parallel to said first side edge and said additional surfaces include a first supplemental top surface extending outwardly from said third side edge to a fourth side edge and parallel to said bottom surface and a third side surface depending from said fourth side edge to said bottom surface, and said second side surface extends from said second side edge to a fifth side edge parallel to said third side edge and said third and fourth side edges being equidistant from said bottom surface, a second supplemental top surface coplanar with said first supplemental top surface and extending outwardly from said fifth side edge to a sixth side edge parallel to said fourth side edge, said fifth and sixth side edges being spaced apart a distance that is the same as the distance between said third and fourth side edges, and a fourth side surface parallel to said third side surface and depending from said sixth side edge to said bottom surface.

7. A connector according to claim 6 wherein said lead is equidistant from a plane perpendicular to said first side surface and said bottom surface.

8. A connector according to claim 6 wherein said lead is a first lead and said connector further includes a second electrical lead equispaced from said first lead and having a bottom end portion on said bottom surface, a top end portion on said main top surface and additional portions on said first side surface, said first supplemental top surface and said third side surface and providing circuit continuity on the exterior of said body between said bottom end portion of said second lead and said top end portion thereof.

9. A connector according to claim 8 further including a third electrical lead aligned with said first lead and having a bottom end portion on said bottom surface, a top end portion on said main top surface and additional portions on said second side surface, said second supplemental top surface and said fourth side surface, and a fourth electrical lead aligned with said second electrical lead and having a bottom end portion on said bottom surface, a top end portion on said main top surface and additional portions on said second side surface, said second supplemental top surface and said fourth side surface, each of said third and fourth leads providing circuit continuity on the exterior of said body between its said bottom end portion and its said top end portion.

10. A connector according to claim 9 wherein said body further includes a flange having a locating surface projecting from at least one of said main top surface, said first and second side surfaces and said first and second supplemental top surfaces.

11. A connector according to claim 10 wherein said locating surface projects from said main top surface, said first and second side surfaces and said first and second supplemental top surfaces and is perpendicular thereto.

12. A mating connector for releasable mating engagement with a connector that is mountable on the surface of a printed circuit board (PCB), which surface mountable connector includes a rigid unitary insulating body having a bottom surface, a main top surface and first and second oppositely facing side surfaces depending from opposite side edges of the main top surface and a first electrical lead on the exterior of the body and providing circuit continuity between a bottom end portion on the bottom surface of the body and a top end portion on the top surface of the body and an additional portion on the first side surface of the body, said mating connector comprising two body members of insulating material pivotally connected for limited movement about a hinge pin, each said member having a downwardly facing planar surface and an inwardly facing planar surface perpendicular to said downwardly facing surface, and spring means urging said inwardly facing surfaces toward each other, said inwardly facing surfaces spaced apart a distance so that they can straddle and engage the first and second side surfaces of the surface mountable connector in positive mating engagement therewith, said mating connector having a configuration for receiving and holding an external circuit element in electrical contact with said lead.

13. A mating connector according to claim 12 wherein said body members are identical and said material thereof is plastic material.

14. A mating connector according to claim 13 wherein each said body member further has an external step and said mating connector additionally comprises a lip member of insulating material removably mounted on each said step and said configuration is provided by a confronting pair of grooves provided by each said body member and its associated said lip member.

15. A mating connector according to claim 14 wherein said configuration is additionally provided by a relieved portion adjacent each said pair of grooves and each said body member further has a groove in its said inwardly facing surface and in open communication with said relieved portion.

16. A mating connector according to claim 14 wherein said insulating material of said lip members is plastic material.

17. A mating connector according to claim 14 further comprising a conductive retainer mounted in said grooves of each said body member, each said retainer having legs with a tapered groove therebetween for receiving and holding a wire.

* * * * *